United States Patent [19]

Masai et al.

[11] 4,165,950

[45] Aug. 28, 1979

[54] FAN HAVING FORWARD-CURVED BLADES

[75] Inventors: Tadahisa Masai, Yamaguchi; Norio Beppu, Yanai; Yoshio Okamoto, Yanai; Kazutoshi Nishikawa, Yanai, all of Japan

[73] Assignee: Hitachi, Ltd., Tokyo, Japan

[21] Appl. No.: 825,044

[22] Filed: Aug. 16, 1977

[30] Foreign Application Priority Data

Sep. 6, 1976 [JP] Japan ..... 51-105819

[51] Int. Cl.[2] ..... F04D 29/30

[52] U.S. Cl. ..... 416/178; 416/187

[58] Field of Search ..... 416/187, 178, 223 A, 416/186, 185, 223 B; 415/213 B, 213 C, 213 R

[56] References Cited

U.S. PATENT DOCUMENTS

| | | | |
|---|---|---|---|
| Re. 18,485 | 5/1932 | Lysholm | 416/223 A |
| 1,749,528 | 3/1930 | Freudenreich et al. | 416/223 A |
| 2,138,814 | 12/1938 | Bressler | 416/187 |
| 2,329,696 | 9/1943 | Chester | 416/188 |
| 3,140,042 | 7/1964 | Fujii | 416/186 X |
| 3,394,876 | 7/1968 | Eck | 415/213 R X |

FOREIGN PATENT DOCUMENTS

| | | | |
|---|---|---|---|
| 2203284 | 8/1973 | Fed. Rep. of Germany | 416/187 |
| 254300 | 7/1927 | Italy | 416/223 A |
| 710391 | 6/1954 | United Kingdom | 416/186 |

*Primary Examiner*—Everette A. Powell, Jr.
*Attorney, Agent, or Firm*—Craig and Antonelli

[57] ABSTRACT

A fan having forward-curved blades, such as a sirrocco fan or cross-flow fan, wherein the width of the outlet of an air passage between the adjacent two blades is 0.28 to 0.52 of the pitch of the blades at the inlet of the air passage, and the width of the inlet of the air passage is 0.85 to 1.2 of the width of the outlet thereof. The fan having blades of this construction has improved efficiency and reduced aerodynamic noise level in operation.

6 Claims, 6 Drawing Figures

FAN HAVING FORWARD-CURVED BLADES

LIST OF PRIOR ART REFERENCES (37 CFR 1.56 (a))

The following references are cited to show the state of the art.

Japanese Patent Publication No. 5589/61, T. Fujii, May 24, 1961.

Japanese Utility Model Publication No. 3134/73, M. Watabiki, Jan. 26, 1973.

This invention relates to fans, and more particularly to improvements in or relating to the shape and configuration of the forward-curved blades mounted on the rotor of a sirocco fan or cross-flow fan.

Fans of this type have hitherto had disadvantages in that they are low in efficiency and produce an aerodynamic noise during operation. These phenomenons will be explained with reference to a sirocco fan shown in FIG. 1 wherein blades 1 formed of a sheet metal are of an arcuate shape and each have a uniform thickness. The numeral 2 designates an inlet of an air passage between the adjacent two blades, and the numeral 3 an outlet of the air passage. Assume that the blades move in the direction of rotation of a rotor as shown by an arrow. Then an air inflow direction 5 relative to the inlet 2 is inclined as shown. This causes a vortical flow region 4 to be produced due to the separation of a boundary layer on the rear surface 7 of each blade 1, producing an energy loss. Thus a stream of air flowing through the adjacent two blades passes along a front surface 6 of each blade. The production of vortical flow regions has hitherto given rise to a reduction in the efficiency of the fan, with the result that the discharge pressure and the flow rate of discharged air are reduced and a noise is produced aerodynamically.

In fans of this type of the prior art, research has hitherto been confined to the optimum values of an inlet angle $\beta_1$ and an outlet angle $\beta_2$. It has generally been ascertained that the optimum values are $\beta_1=90°$ and $\beta_2=170°$, and the fans have been designed on the basis of these values.

Meanwhile, in blades formed of a plastics material, proposals have been made to round the blades at the inlet region of the air passage or the rear surface of each blade. However, the blades of this type have also been low in efficiency and produced an aerodynamic noise during operation. The fans of this type include the following: Japanese Patent Publication 5589/61 discloses blades wherein "the front surface is formed as a concave surface of a trough-shaped cross section in conformity with the inflow direction and the outflow direction of air so as to push out the air flowing through a passage between the blades, the inner end is rounded relatively in a large way, and the rear surface is formed as a convex surface in such a manner that the flow passage gradually tapers in going from the inner periphery toward the outer periphery without having an enlarged portion midway therebetween", so as to prevent the production of a vortical airflow. Japanese Utility Model Publication 3134/73 discloses blades which, although not formed of a plastics material, "have an acoustic material adhering to the rear surface side and are formed in a wing shape in cross section as a whole", so as to prevent the production of a vortical air flow.

This invention has as its object the provision of a fan having forward-curved blades of a specific construction which has improved efficiency and a reduced noise level.

The invention is based on the discovery that the fans of this type have a low degree of reaction. The aforesaid object of the invention is accomplished by rendering the width of the outlet of an air passage between the adjacent two blades substantially equal to the effective width of an air inflow at the inlet of the air passage between the adjacent two blades, and specifying the range of values for the width of the inlet of the air passage with respect to the width of the outlet thereof.

Figure 1:
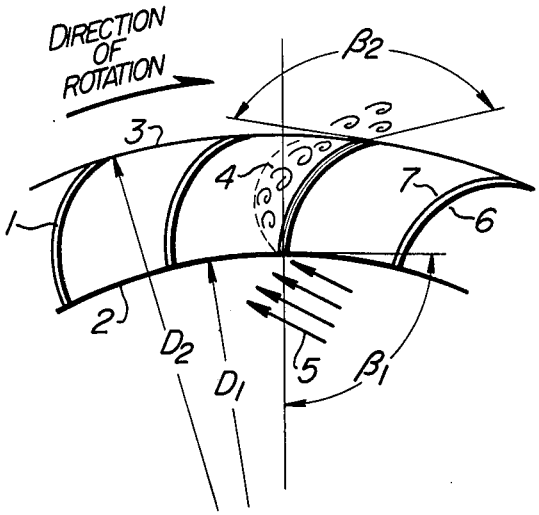
FIG. 1 PRIOR ART
FIG. 1 is a sectional view of blades of the prior art.
Figure 2:
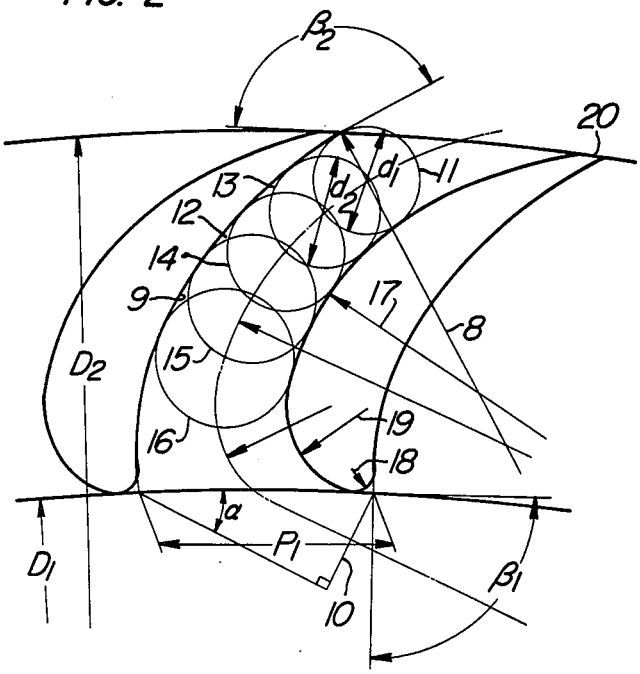
FIG. 2 is a sectional view of the blades comprising one embodiment of the invention.

The invention will now be described with reference to a preferred embodiment shown in FIG. 2.

First of all, the process for determining the shape and configuration of forward-curved blades according to the invention will be described. In the embodiment shown and described, the curve of the front surface of each blade is used as a reference.

The process used for determining the width of the outlet of an air passage between the adjacent two blades will be described. In specifications for forward-curved blades, the values of the inner diameter $D_1$ of rotor blades, the outer diameter $D_2$ of the rotor blades, the number Z of the blades, the inlet angle $\beta_1$ of each blade, the outlet angle $\beta_2$ of each blade, the height B of the blades and the outer peripheral velocity $U_2$ of the rotor blades (which may be the number of revolutions of the rotor) are given as basic technical data.

Then, a flow rate coefficient $\phi$ which provides the forward-curved blades with optimum efficiency is given by equation (1) as follows:

$$\phi = \frac{Q_a/60}{\pi D_2 \cdot B \cdot U_2} \quad (1)$$

where $Q_a$: Airflow Rate (m/min)

$D_2$: Outer Diameter (m) of Rotor Blades

B: Height (m) of Blades $U_2$: Outer Peripheral Velocity ($m^3$/sec)

The relative fluid inlet angle $\alpha$ can be obtained from the velocity triangle at the inlet of the air passage or equation (2):

$$\alpha = \tan^{-1}(\phi/K^2) \quad (2)$$

where K: Ratio of Inner Diameter of Rotor Blades to Outer Diameter Thereof ($D_1/D_2$)

The pitch $P_1$ of the blades at the inlet of the air passage defined thereby can be obtained from the following equation:

$$P_1=\pi D_1/Z \quad (3)$$

Since the inlet angle $\beta_1$ of the blades and the outlet angle $\beta_2$ thereof are known, it is possible to determine a radius 8 of an arbitrary circle to produce the configuration of a front surface 9 of each blade 1. Thus by drawing an arc of the arbitrary circle having the radius 8, the configuration of the front surface 9 of each blade can be obtained.

Also, since the relative fluid inlet angle $\alpha$ can be obtained from the triangle of velocities or equation (2), an effective width e, shown at 10, of air inflow to the inlet of the air passage between the adjacent two blades can be obtained from the following equation:

$$e=P_1 \sin \alpha \quad (4)$$

Then, a first inscribed circle 11 having a diameter $d_1$ substantially equal to the effective width e of the air inflow is drawn in such a manner that the circumference of the circle 11 touches the front surface 9 of the blade 1 at the outlet end thereof. The diameter $d_1$ of the first inscribed circle 11 is the width of the outlet of air passage 12.

The process for determining the air passage 12 will be described. The diameter $d_2$ of a second inscribed cirle 13 is obtained from the following equation on the basis of the diameter $d_1$ of the first inscribed circle:

$$d_2=m\, d_1 \quad (5)$$

where m: Coefficient for Defining the Relation between the Diameters of Adjacent Inscribed Circles The second inscribed circle 13 is drawn in such a manner that its center is located on the circumference of the first inscribed circle 11 and its circumference touches the front surface 9 of the blade 1. Likewise, a third inscribed circle 14, a fourth inscribed circle 15 and so on and so forth are drawn by using the coefficient m of equation (5). If an arc of an arbitrary circle having a radius 17 is drawn in a manner to touch the circumferences of the first to the fifth inscribed circles 11 to 16 (the number of the inscribed circles may vary depending on circumstances), then the configuration of the central portion of the rear surface of each blade 1 can be determined.

Finally, the processes for determining the configurations of the forward end portion and the rearward end portion of each blade 1 will be described in detail. If the forward end portion of each blade 1 has an acute angle like a cutting edge, a hissing sound will be produced during operation. Therefore, the forward end of each blade 1 is rounded in such a manner that the forward end is in the form of an arc of an arbitrary circle having a radius 18. The arcuate forward end of each blade 1 is connected smoothly to the central portion of the rear surface of each blade 1, which is in the form of an arc of the radius 17 as aforesaid, through a rear surface portion in the form of an arc of an arbitrary circle having a radius 19. Thus the forward end portion is smoothly rounded and contiguous with the central portion on the rear surface of each blade 1. On the other hand, a rearward end 20 of each blade 1 is preferably as thin as possible to minimize the wake which would be produced thereby. However, it is usual practice to impart a certain degree of thickness to the rearward end 20 of each blade 1 in actual production of the bladed rotor. By connecting the central portion of the rear surface of each blade, which is in the form of an arc of the radius 17, to the rearward end 20 of each blade through an arc or a straight line, the determination of the configuration of each blade 1 is completed. In the embodiment shown and described herein, the connecting portion is in the form of a straight line.

In the blades 1 of the aforesaid configuration, the width of the outlet of the air passage 12 is equal to the effective width e of an airflow that can be obtained from equation (4) or by other means. The reason for this is stated hereinbelow.

As is well known, a rotor provided with forward-curved blades is low in the degree of reaction and consequently a rise in pressure is low in the air passage 12. Therefore, one may take it for granted that there is no change in the volume flow of air. In the case of a fan having a high ratio K of the inner diameter of rotor blades to the outer diameter thereof, such as a sirocco fan, the relative velocity of air in the air passage 12 is substantially constant. Thus, if the width of the outlet of the air passage 12 is disproportionately small as compared with the pitch $P_1$ of the blades at the inlet of the air passage 12, the airflow rate will be reduced. Conversely, if the outlet has a disproportionately large width, an eddy loss will increase, and reduced fan efficiency and noise level will increase.

In view of this, the width of the outlet of the air passage 12 is determined to be equal to the effective width e of the inflow of air according to the invention. More specifically, if the width of the outlet is shown numerically with respect to the pitch $P_1$ of the blades, the width of the outlet is about 0.34 to 0.48 of the pitch of the blades at the inlet.

The results of experiments conducted so far show that the flow rate coefficient $\phi$ defined by equation (1) is about 0.3 to 0.35 when the efficiency of a fan is maximized. In many cases, the ratio K of the inner diameter of the rotor blades to the outer diameter thereof is about 0.8 to 0.9 when the fans are put to actual use. Thus the relative fluid inlet angle $\alpha$ of equation (2) is about 20 to 29 degrees. From all this, it can be concluded that the width of the outlet of the air passage 12 with respect to the pitch $P_1$ of the blades 1 at the inlet defined by equation (3) is in the range between 0.34 and 0.48.

In order to find out if the theoretically determined values set forth above are correct, experiments were conducted on the flow rate of air and the noise level by varying the values of the width of the outlet of the air passage 12. The conditions of experiments were as follows: the outer diameter $D_1$ of rotor blades $D_2=250$ mm; the inner diameter of rotor blades $D_1=225$ mm; the number of blades $Z=90$; the height of blades $B=25$ mm; the coefficient $m=1.06$; the inlet angle $\beta_1=90°$; the outlet angle $\beta_2=163°$; and the number of revolutions of the rotor was 600 rpm. The same fan casing was used.

Figure 3:
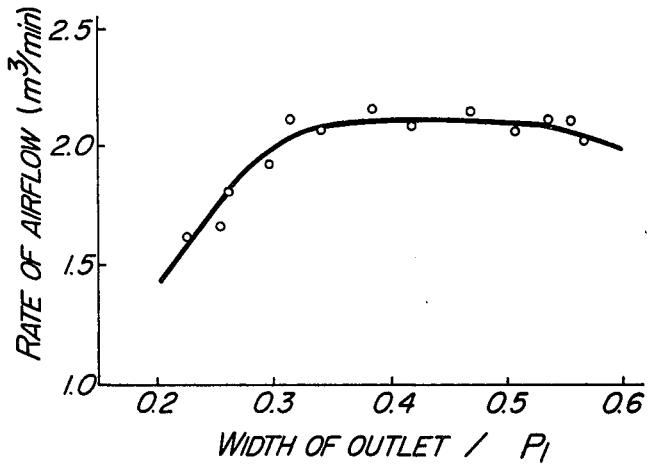
FIG. 3 is a graph showing the results of experiments conducted on the relation between the air flow rate and the width of the outlet of an air passage between the adjacent two blades.
Figure 4:
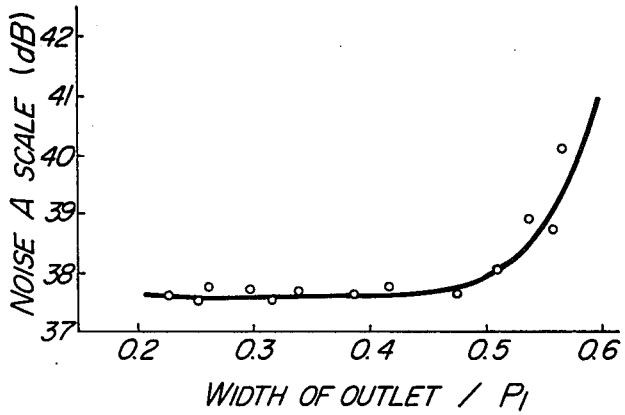
FIG. 4 is a graph showing the results of experiments conducted on the relation between the noise produced and the width of the outlet of an air passage between the adjacent two blades.

It will be seen in FIGS. 3 and 4 showing the results of the experiments that favorable results can be obtained even if the width of the outlet of the air passage 12 is greater than about 0.34 to 0.48 of the pitch $P_1$ of the blades at the inlet and that the outlet width may be 0.3 to 0.5 of the pitch $P_1$.

The coefficient m which determines the shape of the air passage 12 will now be discussed. In order to minimize the vortical flow region 4 formed on the rear surface 7 of each blade 1, it is necessary that the values of the coefficient m should be in a certain range. Therefore, experiments were conducted to obtain the range of values of the coefficient m which permits a high air flow rate and a low noise level to be achieved.

Figure 5:
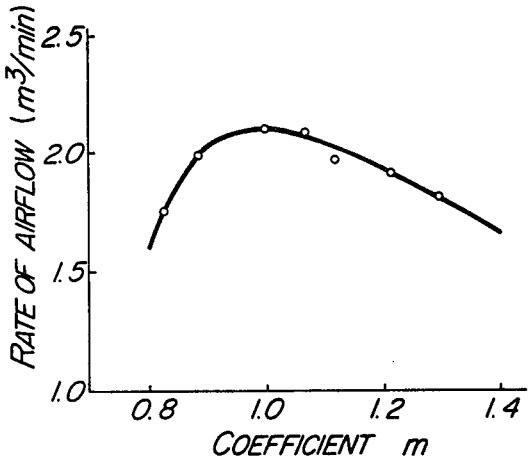
FIG. 5 is a graph showing the results of experiments conducted on the relation between the air flow rate and the coefficient used for determining the air passage.

FIG. 5 shows an airflow rate characteristic with respect to the coefficient m. The fan described with reference to FIGS. 3 and 4 were also used for the experiments to obtain the airflow rate. It will be seen in FIG. 5 that the airflow rate reaches a maximum value when the values of the coefficient m are in the range between 0.95 and 1.05. The maximum flow rate of air attained by fans of the prior art is 1.73 $m^3$/min. It will be apparent that this invention enables a fan of the same dimensions to achieve marked improvements in the rate of airflow as compared with the fans of the prior art.

Figure 6:
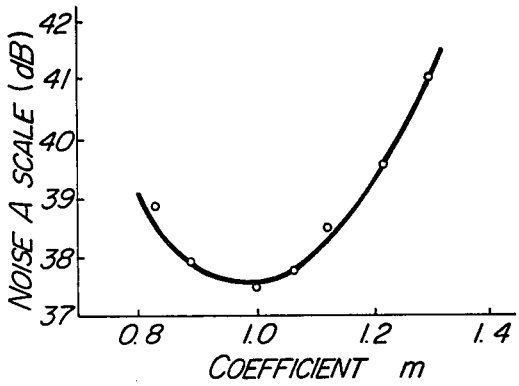
FIG. 6 is a graph showing the results of experiments conducted on the relation between the noise and the coefficient used for determining the air passage.

FIG. 6 shows the results of experiments conducted on the noise produced by the fan according to the invention by setting the rate of airflow at a constant value of 2.0 $m^3$/min. It will be seen in FIG. 6 that, like the rate of airflow shown in FIG. 5, the noise produced by the fan reaches a minimum value when the values of the coefficient m are in the range between 0.95 and 1.05. Fans of the prior art have produced noises of the level of about 42 dB. As can be clearly seen in FIGS. 5 and 6, the fan according to the invention can achieve a higher rate of airflow and a lower level of noise than fans of the prior art.

It is to be understood that the inlet angle $\beta_1$ and the outlet angle $\beta_2$ need not be limited to the aforesaid values if the coefficient m and the ratio of airflow are in the range shown in FIGS. 5 and 6 respectively.

In the embodiment shown and described hereinabove, the invention has been described as determining the shape and configuration of the blades by using the curve of the front surface of each blade as a reference. However, since the invention aims at elimination of the vortical flow region 4 as aforementioned, the reference need not be limited to the curve of the front surface of each blade and the curve of the rear surface of each blade may, for example, be used as a reference. The center line of the air passage 12 may be used as a reference with the same results. That is, according to the invention, the width of the outlet of the air passage has only to be obtained on the basis of an arbitrarily selected reference line.

It should be noted, however, that if a certain reference line is set at the rear surface of each blade and the values of the inlet angle and the outlet angle are set to be $\beta_1 \approx 90°$ and $\beta_2 \approx 170°$, it is not possible to reduce the thickness of the rearward portion of each blade. If the values of the two angles are set to be $\beta_1 < 90°$ and $\beta_2 < 170°$, the rearward portion of each blade can be formed thin and blades can be made similar to the blades produced on the basis of the reference line set at the front surface thereof. Particularly, in the blades of this construction, a turbulence of the air current at the inlet and in the interior of the air passage between the adjacent two blades can be greatly reduced.

The invention has been described with reference to a multibladed fan, but it is to be understood that the invention can also have application in a crossflow fan.

The forward-curved blades according to the invention tends to be larger in thickness than blades of the prior art, because the portion of the air passage in blades of the prior art which has hitherto constituted the vortical flow region 4 formed on the rear surface of each blade becomes an integral part of each blade. Particularly in a fan which has a small number of blades, this tendency is strong. Therefore, if the blades are formed of a plastics material, the fan according to the invention has the disadvantage of becoming higher in cost than blades of the conventional type. In such case, the disadvantage can be eliminated by providing each blade with an axially extending hollow portion, or by forming the blade by using a sheet material.

I claim:

1. In a fan comprising a plurality of forward-curved blades which define air passages between the front surfaces thereof and the rear surfaces of the adjacent blades, the width of each air passage gradually varying from the outlet thereof to the vicinity of the inlet; the improvement comprising the width of the outlet of an air passage, defined by the minimum length between the outlet end of the front surface of the blade and the rear surface of the adjacent blade, being 0.3 to 0.5 of the pitch of the blades at the inlet of the air passage and wherein the width of the air passage and the configuration of the central portion of the rear surface of the adjacent blade are such that they are delimited by an arc of a circle which touches the circumferences of a first through a fifth inner tangent circles, the first inner tangent circle having a diameter equal to the outlet width of the air passage and being positioned in such a manner that the circumference of the circle touches the front surface of the blade at its outlet end, the second inner tanget circle being positioned in such a manner that its center is located on the circumference of the first inner tangent circle and its circumference touches the front surface of the blade, and so forth for the third, fourth and fifth inner tangent circles, the diameters of the second and subsequent tangent circles being defined by the equation:

$$d_2 = md_1$$

where m = coefficient having values in the range between 0.95 and 1.05 for defining the relation between the diameters of adjacent inner tangent circles;

$d_1$ = diameter of the first or preceding inner tangent circle, and;

$d_2$ = diameter of the second or following inner tangent circle.

2. A fan as set forth in claim 1, wherein each of said blades includes a curved front surface in the form of an arc obtained on the basis of the inlet angle $\beta_1$ and the outlet angle $\beta_2$ of each blade and connecting the inlet and outlet ends of each blade. of said blades includes a curved rear surface in the form of an arc obtained on the basis of the inlet angle $\beta_1$ and the outlet angle $\beta_2$ of each blade when $\beta_1 < 90°$ and $\beta_2 < 170°$ and connecting inlet and outlet ends of each blade.

3. The fan of claim 1, wherein the width of the outlet of the air passage is equal to the effective width of the inlet to the air passage.

4. In a fan comprising a plurality of forward-curved blades which define air passages between the front surfaces thereof and the rear surfaces of the adjacent blades, the width of each air passage gradually varying, from the outlet thereof to the vicinity of the inlet; the improvement comprising the width of the outlet of an air passage, defined by the minimum length between the outlet end of the front surface of the blade and the rear surface of the adjacent blade, being 0.3 to 0.5 of the pitch of the blades at the inlet of the air passage and wherein the width of the air passage is such that the front and rear surfaces of the adjacent blades would be tangent with the circumferences of a plurality of inner tangent circles, the first inner tangent circle having a diameter equal to the outlet width of the air passage and being positioned in such a manner that the circumference of the circle touches the front surface of the blade at its outlet end and on its opposite side touches the rear surface of the adjacent blade, the second inner tangent circle being positioned in such a manner that its center is located on the circumference of the first inner tangent circle and so that its circumference touches the opposing front and rear blade surfaces, and so forth for the third and additional inner tangent circles, the diameters of the second and subsequent tangent circles being defined by the equation:

$$d_2 = md_1$$

where m = coefficient having values in the range between 0.95 and 1.05 for defining the relation between the diameters of adjacent inner tangent circles;

$d_1$ = diameter of the first or preceding inner tangent circle, and;

$d_2$ = diameter of the second or following inner tangent circle.

5. A fan as set forth in claim 4, wherein each of said blades includes a curved rear surface in the form of an arc obtained on the basis of the inlet angle $\beta_1$ and the outlet angle $\beta_2$ of each blade when $\beta_1 < 90°$ and $\beta_2 < 170°$ and connecting inlet and outlet ends of each blade.

6. The fan of claim 4, wherein the width of the outlet of the air passage is equal to the effective width of the inlet to the air passage.

* * * * *